166-308 SR
5/10/77 XR 4,022,279

United States Patent [19]

Driver

[11] 4,022,279

[45] May 10, 1977

[54] FORMATION CONDITIONING PROCESS AND SYSTEM

[76] Inventor: W. B. Driver, 19 Sheridan Road, Arnold, Md. 21012

[22] Filed: Dec. 23, 1974

[21] Appl. No.: 535,590

Related U.S. Application Data

[63] Continuation-in-part of Ser. No. 486,875, July 9, 1974, abandoned.

[52] U.S. Cl. ..... 166/271; 166/50; 166/52; 166/272; 166/256; 166/299; 166/303; 166/306; 166/308; 175/61

[51] Int. Cl.[2] ..... E21B 43/14; E21B 43/20; E21B 43/24; E21B 43/26

[58] Field of Search ..... 166/308, 271, 272, 259, 166/306, 305 R, 307, 299, 245, 50, 243, 303, 52; 175/61, 62

[56] References Cited

UNITED STATES PATENTS

| | | | |
|---|---|---|---|
| 1,816,260 | 7/1931 | Lee | 166/50 X |
| 2,404,341 | 7/1946 | Zublin | 166/50 X |
| 2,434,239 | 1/1948 | Zublin | 166/50 X |
| 2,788,956 | 4/1957 | Pevere et al. | 166/259 |
| 3,002,454 | 10/1961 | Chesnut | 166/299 |
| 3,223,158 | 12/1965 | Baker | 166/259 |
| 3,285,335 | 11/1966 | Reistle, Jr. | 166/271 X |
| 3,371,711 | 3/1968 | Odeh et al. | 166/268 |

*Primary Examiner*—Stephen J. Novosad

[57] ABSTRACT

According to the invention, a process and system are disclosed for conditioning an oil or gas formation and the application of the various stimulating fluids to the oil or gas formation. The method consists of drilling from a vertical well hole a horizontal spiralling hole which spirals out into the oil or gas formation and around the vertical well hole. Other embodiments include the drilling of a horizontal inward spiralling well from a vertical well hole that inwardly spirals out into the oil or gas formation from the vertical well hole, and the drilling of a hole from a vertical well hole that spirals out and coils down through an oil or gas formation around the vertical well hole. The application of this process is contingent on the use of my remote control directional drilling system, U.S. Pat. No. 3,811,519, and my flexible drill pipe pending application Ser. No. 465,500, filed Apr. 30, 1974 on related equipment, now abandoned.

20 Claims, 9 Drawing Figures

FORMATION CONDITIONING PROCESS AND SYSTEM

This application is a continuation-in-part of my application titled Formation Conditioning Process And System, filed July 9, 1974 and Ser. No. 486,875, now abandoned.

BACKGROUND OF THE INVENTION

1. Field of the Invention

The invention relates to the conditioning and drilling of oil or gas formations for the application of the various stimulating fluids to increase oil or gas production.

2. Prior Art

It is becoming more important to increase the recoverable oil or gas from an oil or gas formation. Various methods have been used to condition an oil or gas formation to increase production. They consist of drilling straight horizontal or angle holes from a vertical well hole into an oil or gas formation. These methods have not been completely successful in covering the area around a vertical well hole because to be able to drill long distances from a vertical well hole large diameter holes have to be drilled. Only about four large diameter holes can be drilled from one point in a well hole. This leaves at least four large areas around a well hole in which little or no stimulating fluids can be applied. Drilling small straight horizontal holes around a point in a well hole can cover the area around the well hole well, but small straight horizontal holes can not be drilled far enough into the oil or gas formation for sufficient stimulation of the oil or gas formation.

My oil or gas formation conditioning process and well systems would greatly increase the production of oil or gas and would provide the following advantages over present methods and systems.

A horizontal hole drilled from a vertical well hole that spirals out into an oil or gas formation and around the vertical well hole would provide a means of stimulating the oil or gas formation all the way around the vertical well hole at a desired distance from the vertical well hole. One horizontal outward spiralling hole drilled from a vertical well hole could provide a way of stimulating more area around the vertical well hole than four straight horizontal holes drilled at the same depth from a vertical well hole as set forth in U.S. Pat. No. 1,816,260 because of the increasing distance between the straight horizontal holes as their length increases from the vertical well hole. This increasing distance between the four straight horizontal holes leaves four large areas around the vertical well hole that could not be adequately stimulated from the four straight horizontal holes. A horizontal outward spiralling hole around a vertical well hole would provide a way to provide a horizontal drive to push oil or gas to the vertical well hole while four straight horizontal holes drilled from a vertical well hole could only provide a drainage function to the vertical well hole and not a horizontal drive function.

A horizontal outward spiralling hole would not have the channelling problems of four straight horizontal holes which are drilled from the same point in a vertical well hole because of their close proximity near the vertical well hole. A horizontal outward spiralling hole drilled from and around a vertical well hole would be a greater improvement for conditioning the formation around a vertical well hole than the method of trying to horizontally hydraulic fracture around a vertical well hole because to hydraulic horizontal fracture an oil or gas formation depends on the type of oil or gas formation. Most oil or gas formation tend to vertically fracture when fractured with hydraulic fracturing methods. Also if a horizontal fracture was established around a vertical well hole it would extend less than a hundred feet into the formation whereas a horizontal outward spiralling hole would not be limited by the type of oil or gas formation and could be drilled at much greater distances than a hundred feet from the vertical well hole. A horizontal outward spiralling hole drilled from and around a vertical well hole into the bottom part of an oil or gas formation could provide a much greater distribution of water into the oil or gas formation for vertical flooding than the direct injection method of U.S. Pat. No. 3,371,711 because of the varying resistance to direct injected water flow in any oil or gas formation and the greater distance a horizontal outward spiralling hole could place water from a vertical well hole.

A horizontal inward spiralling hole drilled from one vertical well hole into an oil or gas formation could stimulate a much larger area of an oil or gas formation than a well system using two vertical well holes each with a straight horizontal hole which is drilled in association with the straight horizontal hole from the other vertical well hole as shown in U.S. Pat. No. 3,285,335 and U.S. Pat. No. 3,223,158 because a horizontal inward spiralling hole can be drilled with over twice the length of a straight horizontal hole in a given horizontal plane. A horizontal inward spiralling hole can be drilled to stimulate a much wider horizontal area from a vertical well hole than a straight horizontal hole because of the directional limitations of a straight horizontal hole. An inward spiralling hole drilled from a vertical well hole which is drilled from a platform offshore in deep water would provide a better means for conditioning an oil or gas formation for stimulation than the well system of U.S. Pat. No. 3,285,335 and U.S. Pat. No. 3,223,158 because of the economic impractibility of drilling the vertical well holes or mine shafts as shown in U.S. Pat. No. 3,285,335 and U.S. Pat. No. 3,223,158 in an oil or gas formation located off shore in deep water. A horizontal inward spiralling hole drilled from vertical well hole that spirals out into an oil or gas formation and around one or more vertical production wells could provide a much better horizontal drive to the vertical production wells than several vertical injection wells drilled around the vertical production wells because of the uniform drive that can be established from the horizontal inward spiralling hole.

A spiralling coiling hole drilled from a vertical well hole into an oil or gas formation of great vertical thickness that spirals out and coils down through the oil or gas formation around the vertical well hole could provide a way to stimulate more area at a determined distance around the vertical well hole than a series of four straight horizontal holes drilled at the same point at different depths in a vertical well hole as shown in U.S. Pat. No. 1,816,260 and U.S. Pat. No. 3,285,335 that radiate out into the oil or gas because of the distance between the ends of the four straight horizontal holes. A spiralling coiling hole could provide a way to establish a horizontal drive to a vertical well hole in an oil or gas formation with great vertical thickness while straight horizontal holes drilled from the vertical well hole could not provide a horizontal drive to the vertical well hole.

SUMMARY OF THE INVENTION

An object of the invention is to condition an oil or gas formation by drilling a horizontal outward spiralling hole from a well hole that spirals out into the oil or gas formation and around the well hole.

An object of the invention is to condition an oil or gas formation by drilling a horizontal inward spiralling hole that inwardly spirals out into the oil or gas formation from the well hole.

An object of the invention is to condition an oil or gas formation by drilling a spiralling coiling hole from a well hole that spirals out and coils down through the oil or gas formation around the well hole.

An object of the invention is to stimulate an oil or gas formation with stimulating fluids applied from the drilled holes.

DESCRIPTION OF THE PREFERRED EMBODIMENT

Figure 1:
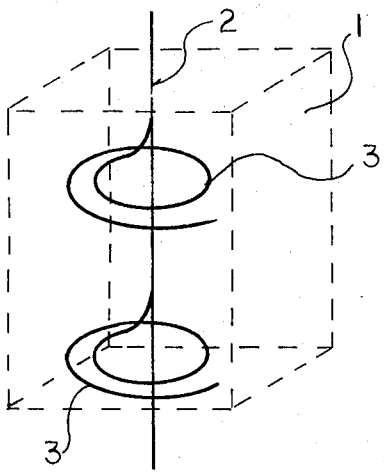
FIG. 1 is a three dimensional view of a vertical well hole in an oil or gas formation with two horizontal outward spiralling holes drilled from the well hole at different depths in the oil or gas formation that spiral around the vertical well hole.

In FIG. 1 a vertical well hole 2 is drilled in oil or gas formation 1. Two horizontal outward spiralling holes 3 are drilled at different depths from the vertical well hole 2 that spiral out into the oil or gas formation 1 and around the vertical well hole 2. Liquid explosive or hydraulic fracturing fluids are used to fracture oil or gas formation 1 from the horizontal outward spiralling holes 3. This method provides a way of fracturing all the way around a vertical well hole 2 at selected distances from vertical well hole 2. Thermal fluids are pumped into the horizontal outward spiralling holes 3 to induce oil or gas flow from the oil or gas formation 1 to the horizontal outward spiralling holes 3 and the vertical well hole 2 where the oil or gas is produced. If oil or gas formation 1 is a deep formation thermal flooding fluids are pumped into only the upper horizontal outward spiralling hole 3 to induce oil or gas flow from oil or gas formation 1 to the lower horizontal outward spiralling hole 3 and the vertical well hole 2 where the oil or gas is produced. Retorting fluids can be pumped into the horizontal outward spiralling holes 3 for the inplace gasification of oil or gas formation 1. Water can be pumped into the lower horizontal outward spiralling hole 3 to displace oil or gas to the upper horizontal spiralling hole 3.

Figure 6:
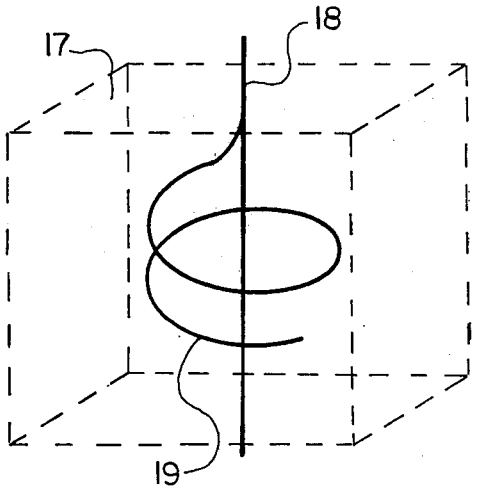
FIG. 6 is a three dimensional view of a vertical well hole drilled in an oil or gas formation. A spiralling coiling hole is drilled from the vertical well hole that spirals out and coils down through the oil or gas formation around the vertical well hole.
Figure 7:
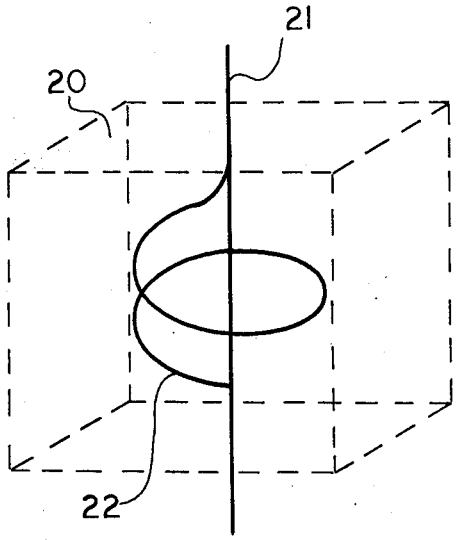
FIG. 7 is a three dimensional view of a vertical well hole drilled in an oil or gas formation with a spiralling coiling hole drilled from the vertical well hole that has its downhole end connected to the vertical well hole.

A variation of the conditioning method as shown in FIG. 1 is shown in FIG. 6. Here a vertical well hole 18 is drilled into oil or gas formation 17. A spiralling coiling hole 19 is drilled from vertical well hole 18 that spirals out and coils down through oil or gas formation 17 around vertical well hole 18. Explosive or hydraulic fracturing fluids are used to fracture oil or gas formation 17 from spiralling coiling hole 19. Thermal fluids are injected into the oil or gas formation 17 from spiralling coiling hole 19 to induce oil or gas flow from oil or gas formation 17 into spiralling coiling hole 19 or vertical well hole 18 where the oil or gas is produced. Retorting fluids can be injected into the spiralling coiling 19 for the inplace gasification of oil or gas formation 17. FIG. 7 is a variation of the conditioning system of FIG. 6. Here a vertical well hole 21 is drilled into oil or gas formation 20 and a spiralling coiling hole 22 is drilled from vertical well hole 21. The downhole end of spiralling coiling hole 22 is directionally drilled to connect to vertical well hole 21, so when the fracturing methods and stimulation fluids as described above are applied to oil or gas formation 20 spiralling coiling hole 22 can provide a drainage function to the lower part of vertical well hole 21. If oil or gas formation 17 and oil or gas formation 20 are deep formations then more than one spiralling coiling hole 19 can be drilled at different depths from vertical well hole 18 and more than one spiralling coiling hole 22 can be drilled at different depths from vertical well hole 21.

Figure 8:
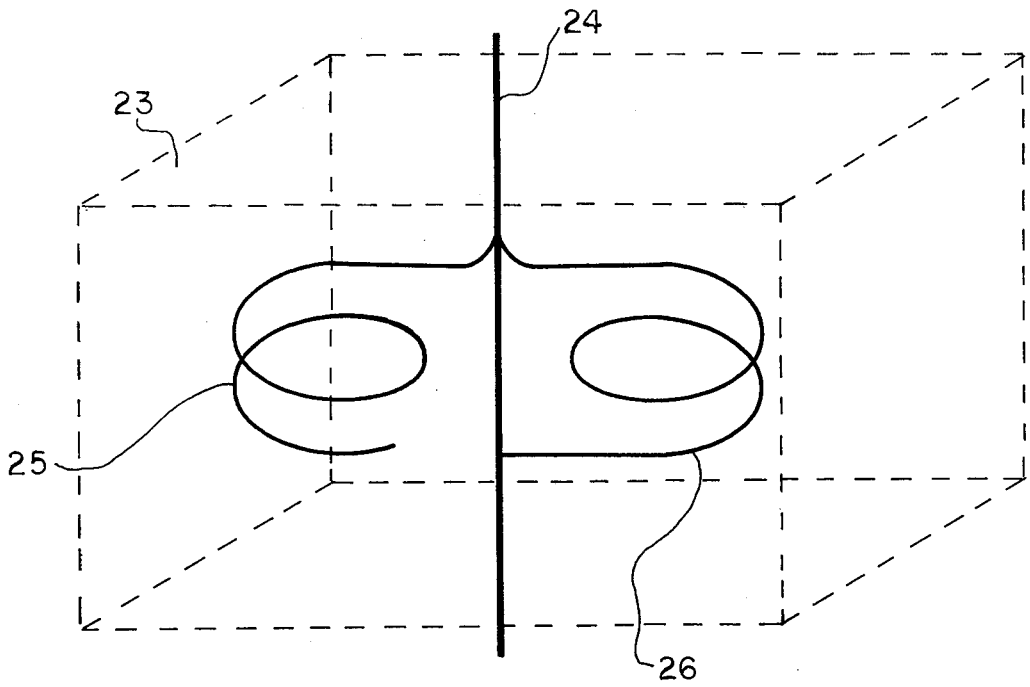
FIG. 8 is a three dimensional view of a vertical well hole drilled in an oil or gas formation. Two spiralling coiling holes are drilled at the same depth from the vertical well hole that spiral out and coil down through the oil or gas formation from the vertical well hole. The downhole end of one of the spiralling coiling holes is connected to the vertical well hole.
Figure 9:
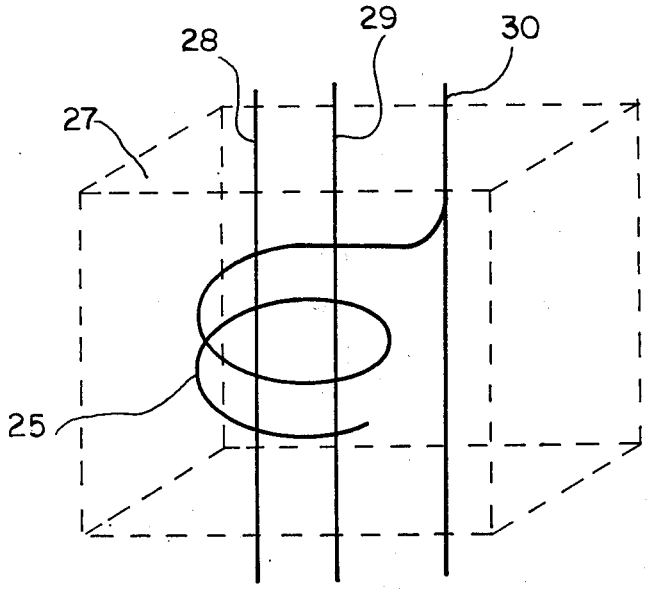
FIG. 9 is a three dimensional view of three vertical well holes drilled in an oil or gas formation. A spiralling coiling hole is drilled from one of the vertical well holes that spirals out and coils down through the oil or gas formation around the other two vertical well holes.

A variation of the condition method as shown in FIG. 6 is shown in FIG. 8. Here a vertical well hole 24 is drilled into an oil or gas formation 23. A spiralling coiling hole 25 is drilled from vertical well hole 24 that spirals out into oil or gas formation 23 and coils down through the oil or gas formation 23 from vertical well hole 24. A second spiralling coiling hole 26 is drilled from vertical well hole 24 at the same depth and is just like spiralling coiling hole 25 except the downhole end of spiralling coiling hole 26 is directionally drilled to connect to vertical well hole 24. The same fracturing methods and stimulation methods can be applied to oil or gas formation 23 as described above from spiralling coiling hole 25 or spiralling coiling hole 26. If oil or gas formation 23 is a deep formation more than one spiralling coiling holes 25 or spiralling coiling holes 26 can be drilled at different depths from vertical well hole 24. A variation of the conditioning method shown in FIG. 8 is shown in FIG. 9. Here vertical well hole 30, vertical production well 29 and vertical production well 28 are drilled into an oil or gas formation 27. A spiralling coiling hole 25 is drilled from vertical well hole 30 that spirals out and coils down through oil or gas formation 27 around vertical production well 28 and vertical production well 29. The same fracturing methods and stimulation fluids as described above can be used to fracture and stimulate the oil or gas formation 27 from spiralling coiling hole 25 to induce oil or gas flow to vertical production well 29 and vertical production well 28. The vertical production well 28 and vertical production well 29 are used as production wells, but vertical production well 28 and vertical production well 29 can be used to inject stimulating fluids into oil or gas formation 27 to induce oil or gas flow to spiralling coiling hole 25 and vertical well hole 30 would be used as a production well. Also the spiralling coiling hole 26 of FIG. 8 can be used inplace of the spiralling coiling hole 25 in FIG. 9 especially if vertical well hole 30 is to be used as a production well.

Figure 2:
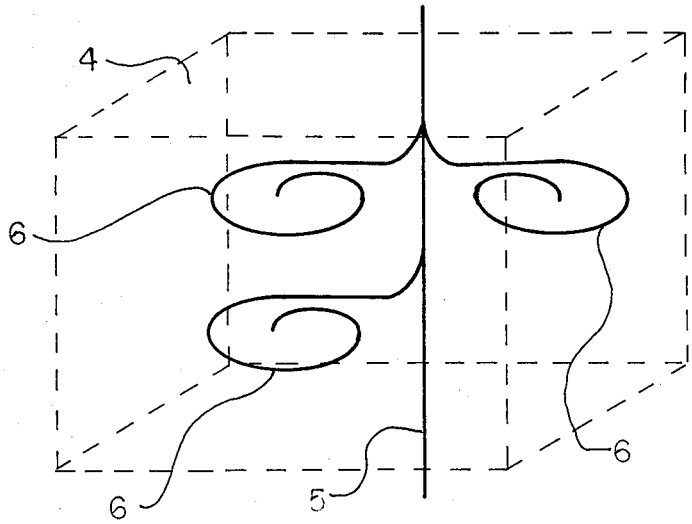
FIG. 2 is a three dimensional view of three horizontal inward spiralling holes drilled from a vertical well hole into an oil or gas formation. Two of the horizontal inward spiralling holes are drilled at the same depth and the last one is drilled from a deeper depth in the oil or gas formation.

In FIG. 2 a method and system for conditioning an oil or gas formation is shown. Here vertical well hole 5 is drilled into oil or gas formation 4. Three horizontal inward spiralling holes 6 are drilled from vertical well hole 5 into oil or gas formation 4 from vertical well hole 5. Two horizontal inward spiralling holes 6 are drilled at the same depth and one horizontal inward spiralling hole 6 is drilled at a lower depth than the other two. Explosive or hydraulic fracturing fluids are used to fracture oil or gas formation 4 from the horizontal inward spiralling holes 6. Thermal fluids are injected into oil or gas formation 4 from the horizontal inward spiralling holes 6 to induce oil or gas flow to the horizontal inward spiralling holes 6 and to the vertical well hole 5. Retorting fluids for the inplace gasification of oil or gas formation 4 can be injected into oil or gas formation 4 from the horizontal inward spiralling holes 6. In the case where oil or gas formation 4 is deep, thermal fluids are injected into oil or gas formation 4 only from the upper horizontal inward spiralling holes 6 to induce oil or gas flow to the lower horizontal inward spiralling holes 6 and to vertical well hole 5. Also water can be injected into the lower horizontal inward spiralling hole 6 to displace oil or gas to the upper horizontal inward spiralling holes 6. More than two horizontal inward spiralling holes 6 can be drilled from the same point and at different depths.

Figure 3:
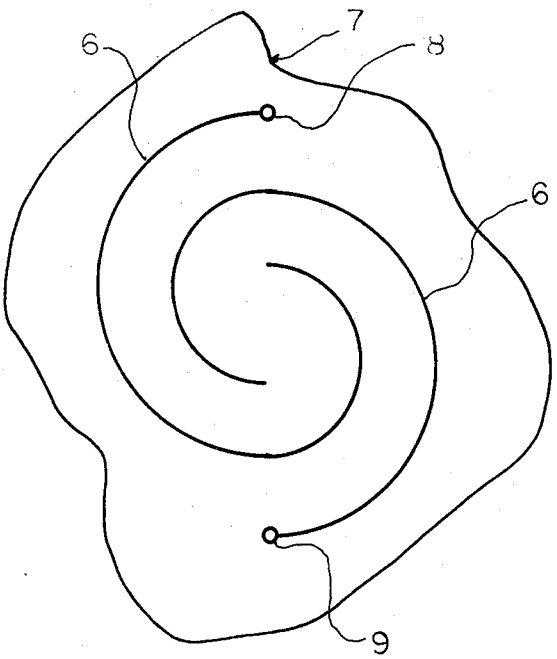
FIG. 3 is a horizontal cross section of two vertical well holes drilled in an oil or gas formation and a horizontal inward spiralling hole is drilled into the oil or gas formation from each vertical well hole. The two horizontal inward spiralling holes are drilled at the same depth and intermesh.

A variation of the conditioning method as shown in FIG. 2 is shown in FIG. 3. Here vertical well hole 8 and vertical well hole 9 are drilled into oil or gas formation 7. A horizontal inward spiralling hole 6 is drilled into oil or gas formation 7 from vertical well hole 9. At the same depth a second horizontal inward spiralling hole 6 is drilled from vertical well hole 8 into oil or gas formation 7 that intermesh but not connected with the horizontal inward spiralling hole 6 drilled from vertical well hole 9. Explosive or hydraulic fracture fluids are used to fracture oil or gas formation 7 from both the horizontal inward spiralling holes 6. Stimulating fluids are injected into oil or gas formation 7 from the horizontal inward spiralling holes 6 to induce oil or gas flow from oil or gas formation 7 to the horizontal inward spiralling holes 6 and to vertical well hole 8 and vertical well hole 9 where the oil and gas is produced. Water or thermal flooding fluids can be injected into oil or gas formation 7 from the horizontal inward spiralling hole 6 drilled from vertical well hole 9 to induce oil or gas flow to the horizontal inward spiralling hole 6 drilled from vertical well hole 8 and the oil or gas is produced from vertical well hole 8.

Figure 5:
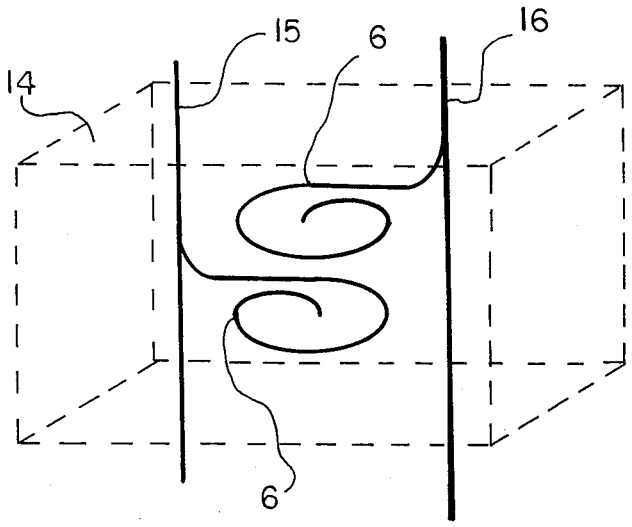
FIG. 5 is a three dimensional view of two vertical well holes drilled in an oil or gas formation. A horizontal inward spiralling hole is drilled in the upper part of the oil or gas formation from one of the vertical well holes. A horizontal inward spiralling hole is drilled in the lower part of the oil or gas formation from the other vertical well hole and directly under the upper horizontal inward spiralling hole.

A variation of the conditioning method shown in FIG. 3 is shown in FIG. 5. Here vertical well hole 15 and vertical well hole 16 are drilled through oil or gas formation 14. A horizontal inward spiralling hole 6 is drilled from vertical well hole 16 into oil or gas formation 14 and a horizontal inward spiralling hole 6 is drilled from vertical well hole 15 at a lower depth than the horizontal inward spiralling hole 6 drilled from vertical well hole 16 and is directly under the horizontal inward spiralling hole 6 drilled from vertical well hole 16. Both horizontal inward spiralling holes 6 are used to fracture oil or gas formation 14. Thermal flood fluids are injected into oil or gas formation 14 from the horizontal inward spiralling hole 6 drilled from vertical well hole 16 to induce oil or gas flow to the horizontal inward spiralling hole 6 drilled from vertical well hole 15. Water can be injected into oil or gas formation 14 from the horizontal inward spiralling hole 6 drilled from vertical well hole 15 to displace oil or gas from oil or gas formation 14 to the horizontal inward spiralling hole 6 drilled from vertical well hole 16.

Figure 4:
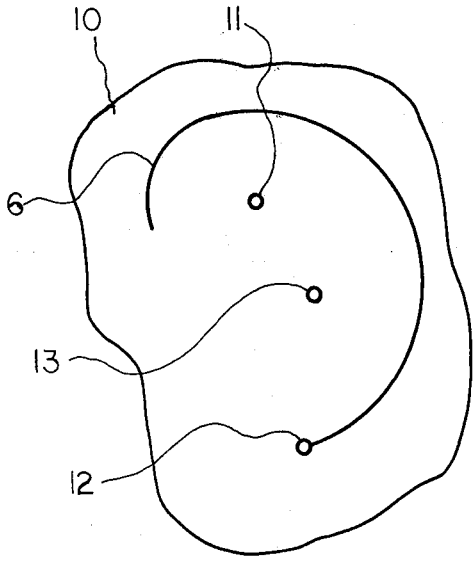
FIG. 4 is horizontal cross section of three vertical well holes drilled in an oil or gas formation. One of the vertical well holes has a horizontal inward spiralling hole drilled from it that inwardly spirals around the the other two vertical well holes.

A variation of the conditioning method as shown in FIG. 2 is shown in FIG. 4. Here vertical production well 11, vertical production well 13 and vertical well hole 12 are drilled in oil or gas formation 10. A horizontal inward spiralling hole 6 is drilled from vertical well hole 12 that spirals inwardly around vertical production well 13 and vertical production well 11 in oil or gas formation 10. Explosive or hydraulic fracturing fluids are used to fracture oil or gas formation 10 from the horizontal inward spiralling hole 6. Water or thermal fluids are injected into oil or gas formation 10 from the horizontal inward spiralling hole 6 to induce oil or gas flow to vertical production well 11 and vertical production well 13 where the oil or gas is produced. Retorting fluids can be injected into oil or gas formation 10 from the horizontal inward spiralling hole 6 for the inplace gasification of oil or gas formation 10. Vertical production well 11 and vertical production well 13 are used as production wells, but vertical production well 11 and vertical production well 13 can be used to inject water or thermal fluids into oil or gas formation 10 to induce oil or gas flow to the horizontal inward spiralling hole 6 and to vertical well hole 12 where the oil or gas is produced.

The oil or gas formation conditioning process and systems as described above can be used to condition coal beds for the inplace gasification of coal.

I claim:

1. A process for conditioning and applying stimulating fluids to an oil or gas formation to increase oil or gas production, wherein the process comprises drilling a vertical well hole through an oil or gas formation, drilling one or more horizontal outward spiralling holes at different depths from the vertical well hole that horizontally spirals out into the oil or gas formation and around the vertical well hole, injecting fracturing fluids into the oil or gas formation from the horizontal outward spiralling hole to fracture the oil or gas formation, injecting stimulating fluids into the oil or gas formation from the horizontal outward spiralling hole to induce oil or gas flow to the horizontal outward spiralling hole and to the vertical well hole where said oil or gas is produced.

2. In the process of claim 1 where more than one horizontal outward spiralling holes are drilled at different depths from the vertical well hole, injecting thermal fluids into the oil or gas formation from the upper horizontal outward spiralling holes to induce oil or gas flow from the oil or gas formation to the lower horizontal outward spiralling holes and to the vertical well hole.

3. In claim 1 a method of improving the application of the vertical water drive method to an oil or gas formation around a vertical well hole that comprises, injecting water into the oil or gas formation from horizontal outward spiralling holes drilled from the vertical well hole into the lower part of the oil or gas formation.

4. A well system comprising a vertical well hole drilled through an oil or gas formation, one or more horizontal outward spiralling holes drilled from the vertical well hole that spiral out into the oil or gas formation and around the vertical well hole.

5. In claim 4 one or more spiralling coiling holes drilled at different depths from the vertical well hole that spiral out into and coil down through the oil or gas formation around the vertical well, the downhole end of one or more spiralling coiling holes connects to the vertical well hole.

6. In claim 4 one or more spiralling coiling holes drilled at the same depth and different depths from the vertical well hole that spiral out into and coil down through the oil or gas formation from the vertical well hole, the downhole end of one or more spiralling coiling holes connects to the vertical well hole.

7. In claim 4 a plurality of vertical production wells are drilled through the oil or gas formation near the vertical well hole, one or more spiralling coiling holes drilled from the vertical well hole that spiral out into and coils down through the oil or gas formation around one or more vertical production wells, the downhole end of one or more of the spiralling coiling holes is connected to the vertical well hole.

8. A process for conditioning and applying stimulation fluids to an oil or gas formation to increase oil or gas production, wherein the process comprises, drilling a vertical well hole through an oil or gas formation, drilling one or more spiralling coiling holes at different depths from the vertical well hole that spirals out into and coils down through the oil or gas formation around the vertical well hole, drilling the downhole end of one or more of the spiralling coiling holes to connect to the vertical well hole, injecting fracturing fluids into the oil or gas formation from the spiralling coiling holes to fracture the oil or gas formation, injecting stimulating fluids into the oil or gas formation from the spiralling coiling holes to induce oil or gas flow from the oil or gas formation to the spiralling coiling holes and to the vertical well hole.

9. In claim 8 drilling one or more spiralling coiling holes at the same depth and at different depths from the vertical well hole that spiral out and coil down through the oil or gas formation from the vertical well hole, drilling the downhole end of one or more of said spiralling coiling holes to connect to the vertical well hole.

10. In claim 9 drilling a plurality of vertical production wells near the vertical well hole, drilling one or more spiralling coiling holes from the vertical well hole that spiral out into and coil down through the oil or gas formation around one or more vertical production wells, drilling the downhole end of one or spiralling coiling holes to connect to the vertical well hole, injecting fracturing fluids into the oil or gas formation around the vertical production wells from the spiralling coiling holes, injecting stimulating fluids into the oil or gas formation from the spiralling coiling holes to induce oil or gas flow from the oil or gas formation to the vertical production wells where said oil or gas is produced.

11. In claim 10 injecting stimulating fluids into the oil or gas formation from the vertical production wells to induce oil or gas flow to the spiralling coiling holes where said oil or gas flows to the vertical well hole where said oil or gas is produced.

12. A process for conditioning and applying stimulating fluids to an oil or gas formation to increase oil or gas production, wherein the process comprise drilling a vertical well hole through an oil or gas formation, drilling one or more horizontal inward spiralling holes at the same depth and at different depths from the vertical well hole that horizontally inwardly spiral into the oil or gas formation from the vertical well hole, injecting fracturing fluids into the oil or gas formation from the horizontally inward spiralling holes to fracture the oil or gas formation, injecting stimulating fluids into the oil or gas formation from the horizontal inward spiralling holes to induce oil or gas flow from the oil or gas formation to the horizontal inward spiralling holes and the vertical well hole where said oil or gas is produced.

13. In claim 12 a method of improving the application of the vertical downward vertical drive method to a large area of an oil or gas formation comprises: injecting thermal fluids into the oil or gas formation from the upper horizontal inward spiralling holes.

14. In claim 12 a method of improving the application of the vertical water drive method to a large area of an oil or gas formation comprises: injecting water into the oil or gas formation from horizontal inward spiralling holes drilled into the lower part of the oil or gas formation from the vertical well hole.

15. In claim 12 drilling a second vertical well hole through the oil or gas formation, drilling a horizontal inward spiralling hole from the second vertical well hole on the same level and intermesh with a horizontal inward spiralling hole drilled from the vertical well hole, injecting fracturing fluids into the oil or gas formation from both said horizontal inward spiralling holes, injecting stimulating fluids into the oil or gas formation from both said horizontal inward spiralling holes to induce oil or gas flow to both said horizontal inward spiralling holes and to the vertical well hole and the second vertical well hole.

16. In claim 12 drilling one or more vertical production wells through the oil or gas formation near the vertical well hole, drilling a horizontal inward spiralling hole from the vertical well hole that horizontally inwardly spirals out into the oil or gas formation and around one or more vertical production wells, injecting stimulating and flooding fluids into the oil or gas formation from the horizontal inward spiralling hole to induce oil or gas flow from the oil or gas formation to the vertical production wells where said oil or gas is produced.

17. In claim 16 injecting stimulating and flood fluids into the oil or gas formation from the one or more vertical production wells to induce oil or gas flow to the horizontal inward spiralling hole.

18. A well system comprising a vertical well hole drilled through an oil or gas formation, one or more horizontal inward spiralling holes drilled at the same depth and at different depths from the vertical well hole that horizontally spiral inwardly out into the oil or gas formation from the vertical well hole.

19. In claim 18 one or more vertical production wells are drilled through the oil or gas formation near the vertical well hole, a horizontal inward spiralling hole drilled from the vertical well hole that horizontally spirals inwardly into the oil or gas formation around the one or more vertical production wells.

20. A well system comprising a vertical well hole drilled through an oil or gas formation, a second vertical well hole drilled through the oil or gas formation near the said vertical well hole, a horizontal inward spiralling hole drilled from the said vertical well hole that horizontally spirals inwardly into the oil or gas formation, a horizontal inward spiralling hole drilled from the second vertical well hole that horizontal spirals inwardly out into the oil or gas formation at the same depths and intermeshes with the horizontal inward spiralling hole drilled from the said vertical well hole.

* * * * *